United States Patent [19]

Bailes

[11] Patent Number: 4,467,991

[45] Date of Patent: Aug. 28, 1984

[54] ARMCHAIR READING STAND

[76] Inventor: Robert B. Bailes, 501 Mimosa Dr., Stigler, Okla. 74462

[21] Appl. No.: 338,803

[22] Filed: Jan. 11, 1982

[51] Int. Cl.[3] ..... A47B 19/00

[52] U.S. Cl. ..... 248/447.1; 248/448; 248/447.2

[58] Field of Search ..... 248/441 B, 441 C, 441 R, 248/444, 448, 236.1; 297/194, 251, 145, 149, 153

[56] References Cited

U.S. PATENT DOCUMENTS

| | | | |
|---|---|---|---|
| 1,082,884 | 12/1913 | Leonard | 297/153 |
| 2,554,559 | 5/1951 | Chadwell | 248/448 |
| 2,720,913 | 10/1955 | Hoppert | 297/153 |
| 2,797,739 | 7/1957 | Orsini | 297/194 |
| 3,185,113 | 5/1965 | Nathan et al. | 297/194 |
| 3,408,032 | 10/1968 | Francis | 297/194 |
| 3,867,401 | 1/1959 | Sheahan | 248/226.1 |

*Primary Examiner*—William H. Schultz
*Assistant Examiner*—Ramon O. Ramirez
*Attorney, Agent, or Firm*—Robert K. Rhea

[57] ABSTRACT

A book and paper supporting elongated rectangular panel transversely overlies the arms of an armchair in a forward and upwardly inclined plane. A pair of standards slidably connected with the undersurface of the panel in tongue and groove fashion overlie the chair arms and support the panel. Each of the standards are provided with opposing chair arm grip plates normally maintaining the standards on the chair arms.

3 Claims, 3 Drawing Figures

ARMCHAIR READING STAND

BACKGROUND OF THE INVENTION

1. Field of the Invention

The present invention relates to article supporting devices and more particularly to an armchair reading or writing platform.

Some individuals, when reading, writing or researching a particular subject, find it convenient to employ a stand or inclined table-like support for holding newspapers, books, writing material, etc. while seated. This invention provides such a paper and book support for armchairs and the like.

2. Description of the Prior Art

Prior patents generally disclose a table-like support for holding writing papers in a horizontal plane supported by the user's legs while seated or overlying the arms of an armchair. Other patents disclose a horizontal support also providing an overlying panel hingedly connected with the horizontal base portion which may be inclined upwardly for use as a writing or reading surface, such as disclosed by U.S. Pat. No. 1,839,291. Other patents, such as U.S. Pat. No. 2,720,913, have formed the support in two sections which are telescopically adjustable longitudinally for extension or contraction and overlying the arms of an armchair, however, none of the prior patents, so far as I know, provide an armchair reading support in which armchair engaging and gripping members are adjustable longitudinally of the stand and individually grip opposite side surfaces of the respective chair arm.

SUMMARY OF THE INVENTION

An elongated rectangular panel transversely overlies the arms of an armchair in a forward and upwardly inclined plane for supporting books, papers, or the like, forwardly of a person seated in the chair. A coextensive lip, secured to the depending marginal edge side of the panel, retains books or papers thereon. The panel is supported by a pair of standards depending from the undersurface of the panel intermediate its ends. Each of the standards is slidably secured to the undersurface of the panel in tongue and groove fashion. Each of the standards is provided with a pair of grip plates on opposing sides of its depending end portion overlapping and gripping opposing sides of the chair arm by a resilient member urging the grip plates toward the standard, each standard being provided with an underlying planar base overlying the respective chair arm to prevent tilting action of the stand toward and away from the user.

The principal object of this invention is to provide a book and reading paper holding stand for use with substantially any chair equipped with arms.

DESCRIPTION OF THE PREFERRED EMBODIMENT

Figure 1:
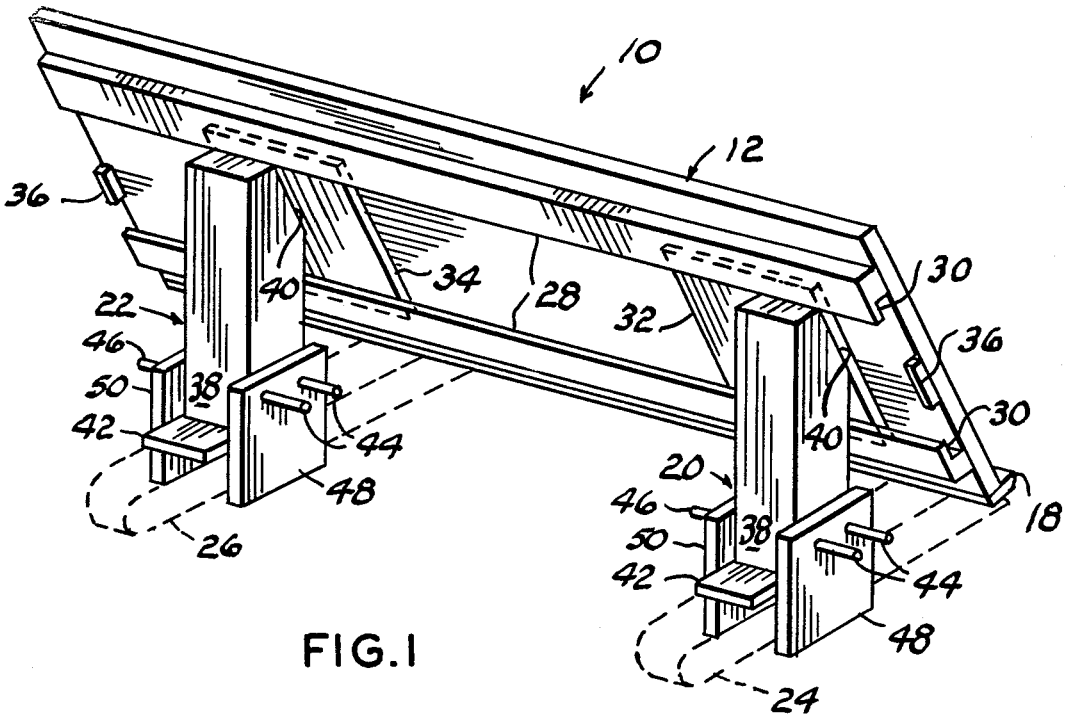
FIG. 1 is a perspective view of the stand supported by a pair of chair arms, the latter being shown by dotted lines.
Figure 2:
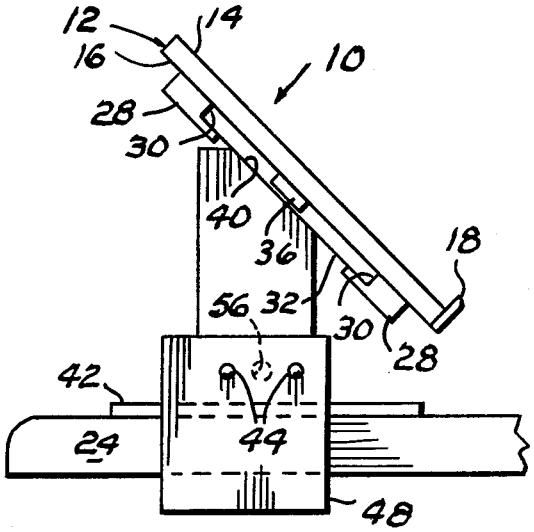
FIG. 2 is an end elevational view of the stand.
Figure 3:
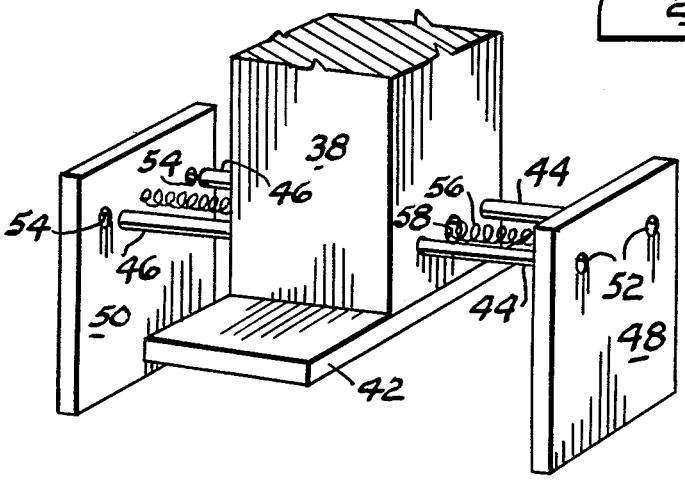
FIG. 3 is a fragmentary exploded perspective view illustrating the manner of mounting the armchair grip plates.

Like characters of reference designate like parts in those figures of the drawings in which they occur.

The reference numeral 10 indicates the device, as a whole, which is rectangular planar in general configuration comprising an elongated inclined panel 12 defining an inclined upper surface 14 and an opposing undersurface 16. An elongated bar, coextensive with the panel, is secured to its depending longitudinal edge to form a lip 18 for retaining books or papers on the panel inclined upper surface 14. A pair of panel supporting standard means 20 and 22 depend from the panel undersurface 16 and overlie the arms 24 and 26 of an armchair, or the like.

A pair of rails 28, coextensive with the length of the panel, are longitudinally secured to the panel undersurface 16 adjacent its upper and lower edge portions, respectively. The rails are provided with confronting rabbeted edges 30 forming a tongue groove for receiving opposing end edge portions of a pair of sliding plates 32 and 34 for longitudinal sliding movement relative to the panel 12 toward and away from each other and toward and away from the respective ends of the panel. The sliding plates are retained within the rabbeted edges by a stop 36 secured to the panel undersurface 16 at its respective ends.

The standard means 20 and 22 are identical and only the standard means 20 is described in detail in the interest of brevity. The standard means 20 comprises a standard 38 preferably rectangular in transverse section having a width preferably less than the width of a chair arm, such as the arm 24, and a length sufficient to dispose the panel lip 18 adjacent but spaced above the upper limit of the respective chair arm 24 or 26. An upper edge portion of the standard 38 is cut away or beveled, as at 40, on an angle parallel with the desired plane in which the panel 12 is to be disposed. This standard inclined edge surface 40 is rigidly secured to the sliding plate 32 within the spacing between the rabbeted edges 30 of the rails and preferably towards the edge of the plate disposed toward the adjacent end of the panel 12. An elongated planar base 42 underlies the depending end of the standard 38 and is rigidly secured thereto and longitudinally overlies the upper surface of the chair arm 24 for the purpose of preventing a tilting action of the device 10 toward and away from a user when seated in a chair.

Two pairs of dowels 44 and 46 are respectively secured to opposing sides of the standard 38 in a common horizontal plane and project laterally of the standard and chair arm 24. A pair of vertically disposed rectangular grip plates 48 and 50 are each provided with a pair of cooperating apertures 52 and 54 in their upper end portion for slidably receiving the respective pairs of dowels 44 and 46 with the other depending end portion of the grip plates disposed on opposing sides of the chair arm 24. The grip plates are urged toward each other in gripping relation on opposing sides of the chair arm by a resilient member, such as a helical spring 56, extending through a horizntal bore 58 formed through the depending end of the standard in the plane of the pairs of dowels and secured at its respective ends to the inwardly disposed surface of the respective grip plate 48 and 50.

OPERATION

In operation, the user, when seated in an armchair, places the device 10 forwardly of himself on the chair arms by sliding one or both of the standard means 20 and 22 to a position overlying the respective chair arm and manually spreads the grip plates apart against the resilience of the spring 56 so that the base plates 42 flatly contact the upper surface of the chair arms and the grip plates 48 and 50 grip opposing side surfaces of the chair arms to support the device 10 thereon.

Obviously the invention is susceptible to changes or alterations without defeating its practicability. Therefore, I do not wish to be confined to the preferred embodiment shown in the drawings and described herein.

I claim:

1. A book and paper supporting stand for an armchair, or the like, comprising:

an elongated panel adapted to extend transversely across the arms of an armchair, or the like, in a forward and upwardly inclined plane defining an upper and a lower panel surface;

a pair of standards depending from and supporting said panel above chair arms when disposed thereon;

tongue and groove means slidably connecting said standard with said panel, said tongue and groove means including a pair of rails secured to the lower panel surface adjacent its respective longitudinal upper and lower edges, each said rail having a longitudinal rabbeted edge disposed in confronting relation with the rabbeted edge of the opposite rail, and, a sliding plate secured to the upper end portion of the respective standard and having opposing edge portions slidably received by the respective rail rabbeted edge; and, grip plate means connected with the respective standard for maintaining the pair of standards on chair arms when disposed thereon.

2. The stand according to claim 1 in which said grip plate means includes:

a plurality of dowels secured to and projecting laterally of the depending end portion of each said standard parallel with the longitudinal axis of said panel;

a pair of grip plates disposed on opposing sides of the respective said standard, each grip plate of said pair of grip plates having a like plurality of apertures slidably receiving the respective said dowels; and, resilient means biasing said pair of grip plates toward the respective said standard.

3. The standard according to claim 2 in which the depending end portion of each standard is transversely bored and said resilient means includes:

a helical spring extending through the standard bore and connected at its respective ends with said pair of grip plates.

* * * * *